United States Patent [19]

Brown

[11] 3,958,587

[45] May 25, 1976

[54] MANIFOLD FOR FLUID DISTRIBUTION AND REMOVAL

[75] Inventor: Silas A. Brown, Lake Elmo, Minn.

[73] Assignee: Buckbee-Mears Company, St. Paul, Minn.

[22] Filed: Dec. 19, 1974

[21] Appl. No.: 534,212

[52] U.S. Cl. ..... 138/198; 134/122 R

[51] Int. Cl.[2] ..... B08B 3/02

[58] Field of Search ..... 134/9, 15, 64 R, 64 P, 134/122 R, 122 P, 198

[56] References Cited

UNITED STATES PATENTS

| | | | |
|---|---|---|---|
| 3,044,098 | 7/1962 | Stalson | 134/64 R X |
| 3,399,685 | 9/1968 | Jones et al. | 134/64 R |
| 3,468,362 | 9/1969 | Burkhardt et al. | 134/15 X |
| 3,682,185 | 8/1972 | Murray et al. | 134/122 R |

FOREIGN PATENTS OR APPLICATIONS

| | | | |
|---|---|---|---|
| 1,461,609 | 11/1966 | France | 134/198 |

*Primary Examiner*—Robert L. Bleutge
*Attorney, Agent, or Firm*—Jacobson and Johnson

[57] ABSTRACT

A manifold is provided for use in the etching or plating of materials which continuously supplies fresh fluid to the surface of an article to be etched while continuously removing the old fluid that is adjacent the surface of the article that is to be etched. The transfer of fluid is accomplished by a plurality of sources and a plurality of funnel-like sinks.

7 Claims, 2 Drawing Figures

MANIFOLD FOR FLUID DISTRIBUTION AND REMOVAL

BACKGROUND OF THE INVENTION

1. Field of the Invention

This invention relates generally to a manifold or member for delivering fresh fluid and, more specifically, to a manifold for supplying fresh etchant and removing spent etchant from an article being etched.

2. Description of the Prior Art

In the prior art, the process of etching articles by etchant fluids is well known. A typical process is to use a series of jets or spray nozzles which direct a stream of etchant fluid onto an article to be etched. This process has a drawback in that the impinging fluid stream often contains sufficient momentum so as to dislodge or break away the resist thus causing portions of the protected surface to be etched away.

Another method which does not have the disadvantage of breaking the resist is the immersion etching of the article. That is, by immersing the article to be etched in a tank of etchant, one eliminates the breakage of resist due to the momentum of the etchant. However, in immersion it is usually difficult to continually supply fresh etching fluid to the article to be etched.

However, neither of the processes described, i.e., the utilization of jets or immersion etching has proven entirely effective for etching precision articles, that is, it is difficult to obtain good resolution by either using fluid jets or immersing an article in an etching tank. One of the problems of the utilization of jets which has been most troublesome is that when the fluid impinges on the article to be etched, it also impinges on the resist which oftentimes breaks off portions of the protective resist and thus makes the edges of the article subject to overetching. Consequently, the article which is etched by use of impinging jets will usually have poor resolution. For very precision etching, this type of resolution is not acceptable and particularly in those instances where it is required to accurately etch a hole in an article which has a dimension less than the thickness of the material to be etched through.

The present invention is a discovery that a fluid manifold which has a plurality of sources and sinks can coact to supply a fluid sheet of material to the surface of the article to be etched which results in an article which has a resolution that is considerably better than obtained by the prior art techniques which utilize spray jets.

SUMMARY OF THE INVENTION

Briefly, the invention comprises a discovery that a utilization of a plurality of sources and sinks wherein etching fluid is distributed to the surface of an article to be etched by a plurality of sources and is removed from the surface of the article by a plurality of funnel-like discharge chambers or sinks has been found to provide a continuous supply of fresh etching fluid to the article to be etched and thereby produces an etched product having high resolution.

DESCRIPTION OF THE PREFERRED EMBODIMENT

Figure 2:
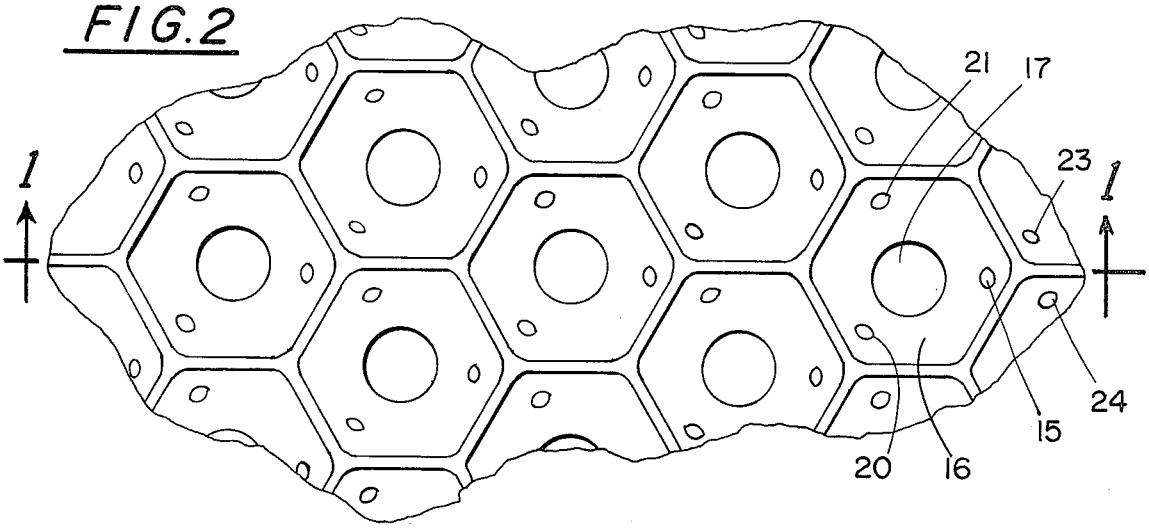
FIG. 2 is a top view of the top surface of my fluid distribution manifold.
Figure 1:
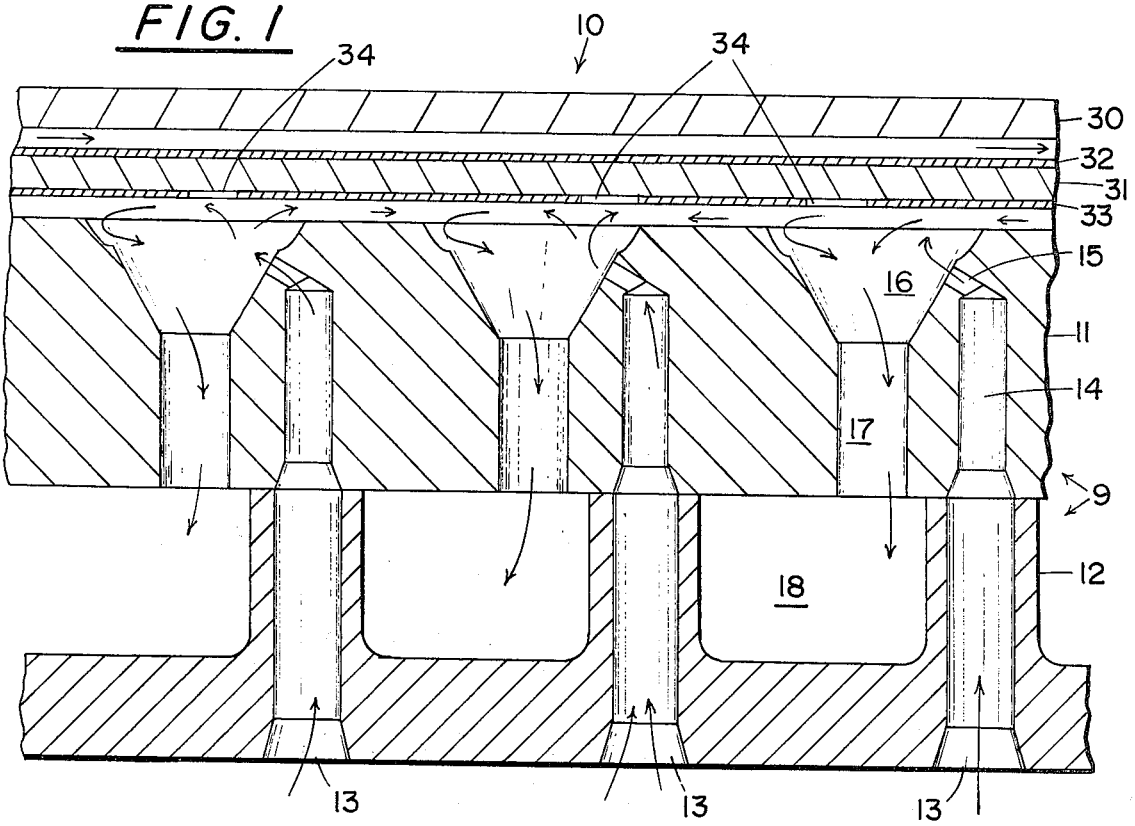
FIG. 1 is a front elevation view showing my fluid distribution manifold in section.

Referring to the drawing, reference numeral 10 generally designates my fluid distribution manifold 9 and an article 31 which is to be etched. Fluid distribution manifold or member 9 comprises a top section 11 having a flat surface on the top side and a bottom side which is fastened to the top side of bottom section 12 by suitable fastening means (not shown). Located in bottom section 12 is a set of fluid inlets 13 for directing incoming fluid into a set of inlet regions 14 which are located in top section 11.

Typically, fluid inlets 13 are supplied with fluid from an inlet plenum chamber where the pressure and flow of the incoming fluid is controlled by conventional pressure and flow regulators. Inlet region 14 has a set of three fluid passages 15, 23 and 24 (FIG. 2) which connect to three identical funnel-like regions 16. The funnel-like regions 16 are located in spaced relationship on the top surface of top section 11. Funnel-like regions 16 are referred to as fluid sinks or fluid discharge passages and the fluid passages 15, 23 and 24 are designated as sources of fluid. FIG. 2 reveals the three passages 15, 23 and 24 which are connected to a single inlet region 14.

In the preferred embodiment the fluid passages 15, 23 and 24 are orientated so that the central axis of each of the fluid passages 15, 23 and 24 is somewhat tangential to the funnel-like region 16 to thereby introduce a swirling or vortical mixing of the fluid. In addition, it is preferred to have the central axis of each of the fluid passages 15, 23 and 24 such that fluid is discharged at an acute angle to the surface of the article to be etched rather than at a right angle.

Located above the top flat surface of top section 11 is an article 31 which is to be etched. Article 31 has a first layer of resist 32 and a second layer of resist 33 which contains void regions 34 where the article is to be etched. The fluid after etching the surface of article 31 discharges through funnel-like chamber 16, passage 17 and into a discharge plenum chamber 19. Only one set of inlet passages and one discharge passage have been described because the other inlet and discharge parts are identical thereto.

A reference to FIG. 2 will show that three sources are combined within each sink so that the three fluid inlets are spaced equally around the periphery of funnel-like member 16 to thereby distribute the fluid within each chamber region. While the top shape of funnel-like member 16 is shown as hexagonal, other shapes are also suitable, however, the hexagonal shape is preferred because it allows one to have the portions of material between adjacent funnel-like members of equal and minimum dimensions. Typically, the maximum dimension of the funnel-like member is less than an inch thus allowing for many sinks and sources to be placed adjacent an article to be etched.

In operation of my invention, article 31 to be etched is placed between backing member 30 and the top surface of top section 11. Fluid is supplied to the top side of article 31 by a source (not shown) and fluid is supplied to the bottom side of the article by the plurality of sources and sinks located in top member 11. By supplying fluid from both sides, one can hydrostatically suspend article 31 between the back support member 30 and top surface 11. This provides an added benefit in that a fluid bearing is obtained for moving article 31 through the manifold.

In the above apparatus it has been found that although the fluid flow pattern of etchant is not fully understood, one can obtain excellent etching resolution as well as allowing one to use the etchant at room temperature by supplying etchant fluid through inlet regions 14 and removing it through funnel-like passages 16.

I claim:

1. An apparatus for the uniform distribution of fluid to the surface of an article comprising:

a fluid distributing member having a plurality of fluid sources located therein for supplying fluid to the surface of an article, each of said plurality of sources having a plurality of fluid inlets for directing fluid at an acute angle with respect to the surface of the article so that the momentum of the incoming fluid is substantially tangential to the surface of the article;

a back member located in spaced relationship from said fluid distributing member, said back member and said fluid distributing member defining a chamber where said back member and said fluid distributing member are uniformly spaced from one another, to thereby allow an article to be inserted in said chamber; said plurality of sources located in spaced relationship to one another to thereby distribute the fluid to the surface of the article which is held in a spaced relationship from said plurality of sources by the fluid supplied from said plurality of sources, a plurality of sinks located in said member, said plurality of sinks located in spaced relationship to one another and in fluid communication with said fluid inlets to thereby remove fluid which is supplied to the surface of the article.

2. The apparatus of claim 1 wherein the fluid sources are operable to distribute etchant fluid and an article is hydrostatically supported between said back member and said member having a plurality of sources.

3. The invention of claim 1 wherein said plurality of sinks have a funnel-like converging section.

4. The invention of claim 3 wherein said plurality of sources are located in each of said sinks.

5. The invention of claim 4 wherein said plurality of sinks have a hexagonal shape.

6. The invention of claim 5 wherein each of said plurality of sinks have at least three sources of fluid located therein.

7. The invention of claim 6 wherein each of said plurality of sources emits fluid at an acute angle with respect to an article to be etched.

* * * * *